United States Patent [19]

Oswalt et al.

[11] Patent Number: 4,977,630

[45] Date of Patent: Dec. 18, 1990

[54] PATIENT MOVER

[76] Inventors: James A. Oswalt; Brenda K. Oswalt, both of 23202 Petrich La., Tomball, Tex. 77375

[21] Appl. No.: 66,266

[22] Filed: Jun. 25, 1987

[51] Int. Cl.[5] ..... A61G 7/08

[52] U.S. Cl. ..... 5/81 R; 5/432; 297/440

[58] Field of Search ..... 5/66, 81 R, 82 R, 431–433, 5/446, DIG. 1; 128/87 R; 297/440

[56] References Cited

U.S. PATENT DOCUMENTS

| | | | |
|---|---|---|---|
| 2,208,945 | 7/1940 | Miller | 5/433 X |
| 2,677,159 | 5/1954 | Berg . | |
| 2,777,138 | 1/1957 | Gallagher | 5/433 |
| 3,515,419 | 2/1971 | Allard et al. | 5/431 X |
| 3,675,255 | 7/1972 | Johansson . | |
| 3,890,659 | 6/1975 | Staubs . | |
| 4,060,079 | 11/1977 | Reinhold, Jr. . | |
| 4,064,574 | 12/1977 | Schnitzler . | |
| 4,209,011 | 6/1980 | Peck et al. | 128/87 R |
| 4,369,982 | 2/1983 | Hein . | |
| 4,383,526 | 5/1983 | Robins | 120/87 R |
| 4,516,282 | 5/1985 | Topalian et al. | 5/433 X |
| 4,534,075 | 8/1985 | Schnitzler . | |
| 4,584,729 | 4/1986 | Roberts . | |
| 4,641,385 | 2/1987 | Peters . | |

*Primary Examiner*—Michael F. Trettel

[57] ABSTRACT

An apparatus for use in moving a small child who has been injured or sick. The apparatus includes a base, and a flexible flat board mounted to the base. The ends of the board can be moved to a raised position to accommodate the child. The apparatus also includes supports for supporting the ends of the board when they are in the raised position. The base, board, and support means have pluralities of openings for use in immobilizing the child and in securing the apparatus to a stretcher.

13 Claims, 3 Drawing Sheets

PATIENT MOVER

BACKGROUND OF THE INVENTION

This invention relates to a patient mover and support apparatus for carrying a small child in an ambulance, transporting a small child to or from an ambulance on a stretcher, and inter-departmental stretcher transfer of a small child in a hospital or other medical facility. Presently, three methods are used in carrying a small child or infant in an ambulance. First, the child or infant is strapped onto a conventional patient mover designed for much larger patients. Second, an emergency medical attendant carries the child in the ambulance during the trip to the hospital. Third, a conventional child's car seat is carried on the ambulance and is used in transporting a child to the hospital.

All of the foregoing methods of carrying children in an ambulance have serious drawbacks. The straps used on conventional patient movers to secure a patient cannot be adequately adjusted to securely confine a small child or infant to the patient mover since these straps and the patient movers are designed for larger patients. Thus, a child may slip or be thrown from underneath the straps of a conventional patient mover during transit resulting in further injury to the child. The use of a conventional car seat is not always adequate since placing and carrying a child in a car seat could aggravate the injury or sickness of that child. Additionally, ambulances are so crowded with emergency equipment that often times pieces of emergency medical equipment have to be removed from the ambulance in order for a conventional car seat to be added to the equipment carried by the ambulance. Further, an emergency medical attendant who carries a child may not have a secure enough grasp on the child to keep the child from being flung from his arms if the ambulance makes an emergency stop or gets into an accident on way to the hospital.

SUMMARY OF THE INVENTION

The present invention is for a patient mover and patient support apparatus for carrying a small child in emergency vehicles. The present invention has a flat rectangular base and a flexible or hinged rectangular patient support board. The support board is attached to the base towards the middles of the base and of the patient support board. The patient support board has an upper and lower body member which can be moved from a normal position which is parallel to the base to a raised position which is in angular relationship with the base. The board also has support means for supporting the upper and lower body members in the raised position.

In use, the patient support apparatus is adjusted to its carrying position. The injured or sick child is then placed on the patient support apparatus and secured to the apparatus. The patient support apparatus is carried to the emergency vehicle and strapped to some object in the emergency vehicle, such as the stretcher. When the vehicle arrives at the hospital, the straps are removed from the apparatus and the child is carried into the hospital on the patient support apparatus.

An object of the present invention is to provide a patient support apparatus which can be used for carrying small children, which is adjustable to various positions to accommodate the type of injury or sickness of the small child, and which is collapsible when not in use to a configuration which is easily stored on an ambulance.

Another object of the present invention is to provide a collapsible patient support apparatus which can be adjusted to a plurality of positions depending upon the nature of the sickness or injury to the patient.

Another object of the present invention is to provide a patient support apparatus which is easily and conveniently stored on an ambulance when not in use.

Another object of the present invention is to provide a patient support apparatus which can be used to transport small children and which can be affixed to a stretcher during transportation of the patient to the hospital.

A further object of the present invention is to provide a safe means for transporting a sick or injured child from the scene of the injury or sickness to a hospital.

Other objects and advantages of this invention will be obvious when one reviews the description and drawings set forth herein.

DESCRIPTION OF THE PREFERRED EMBODIMENT

Figure 1:
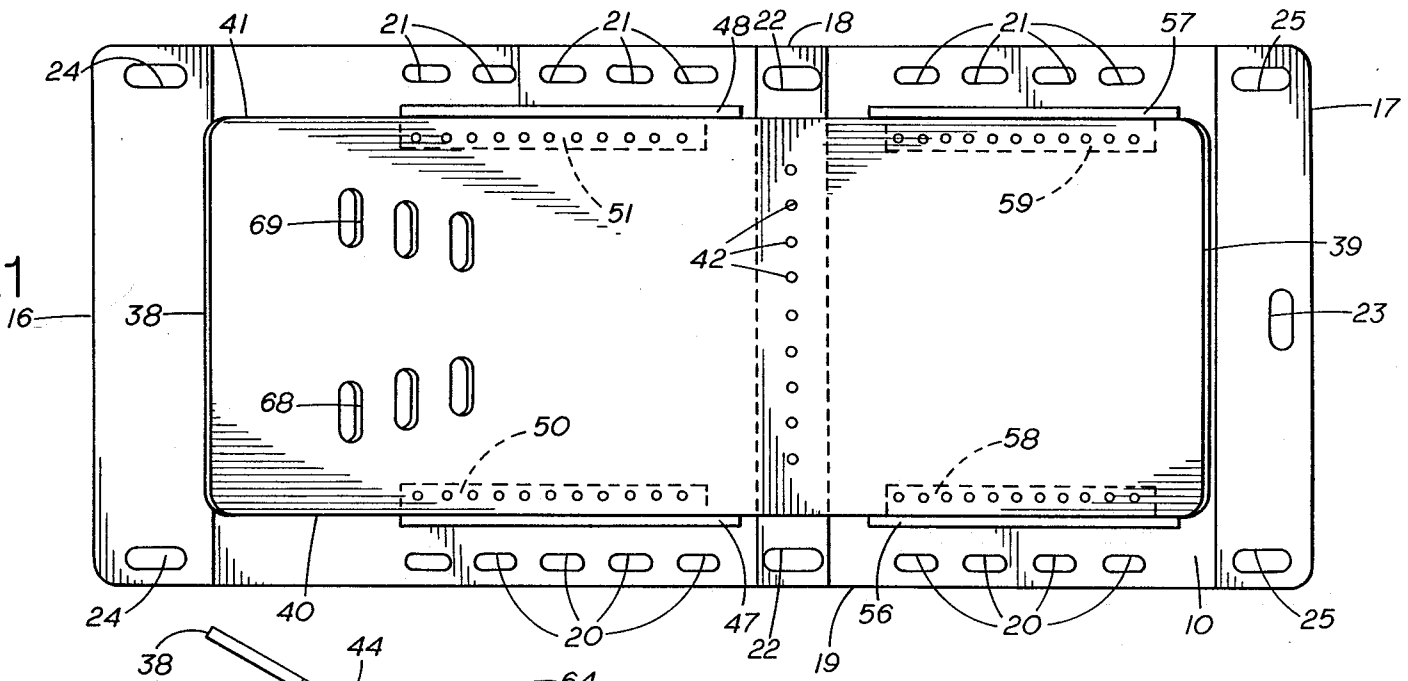
FIG. 1 shows a plan view of the patient support apparatus with the upper and lower body members in their raised position and the side panels in their support position.
Figure 2:
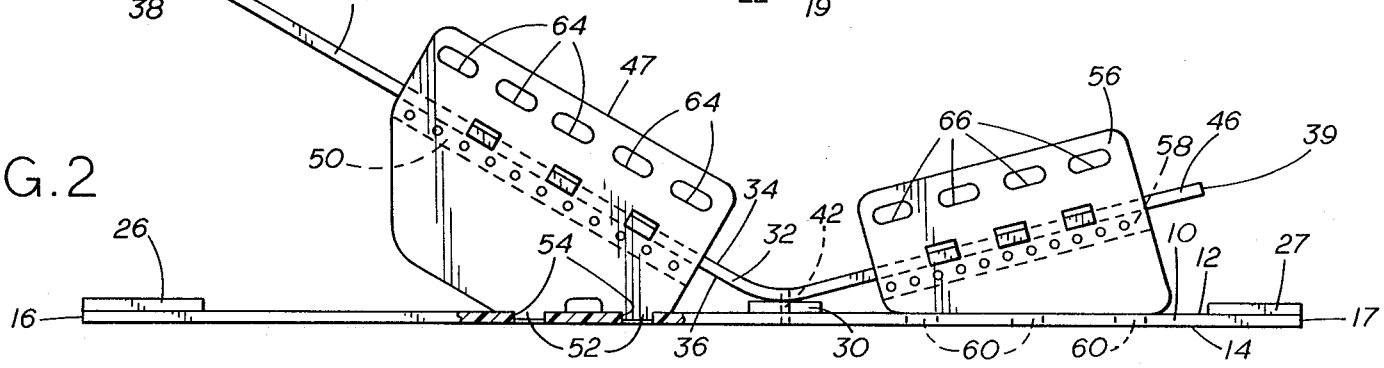
FIG. 2 show a side view of the patient support apparatus shown in FIG. 1.

As illustrated in FIGS. 1 and 2, the patient support apparatus of the present invention includes a generally rectangular flat base 10 of uniform thickness. The base 10 has a top 12, a bottom 14, two ends 16, 17, and two sides 18, 19. The base 10 can be made from a wide variety of materials including almost all types of plastics, fiberglass, wood, metals, or any combination of the above materials. In the preferred embodiment, the base 10 is rigid and of sufficient thickness and strength to support a patient. The base 10 has two rows of openings 20, 21 adjacent to the sides 18, 19 of base 10. As will be set forth in more detail herein, the openings 20, 21 provide hand holds for use in transporting the patient support apparatus from place to place, or as holes for inserting straps to hold the patient support apparatus to a stretcher. The base 10 has opening 23 to provide a means for strapping the base to the stretcher so as to securely hold the support apparatus during sudden stop or head on crash. Additionally, as illustrated in FIG. 1, the base 10 has two openings 22 at its midpoint adjacent to sides 18 and 19, two openings 24 located adjacent to end 16 and sides 18 and 19, and two openings 25 adjacent to end 17 and sides 18 and 19. All of these openings can be used as either hand holds or for inserting straps to fasten the base 10 to other objects such as an ambulance stretcher.

Stiffener 26 is attached to the top of the base 10 adjacent to end 16. Similarly, stiffener 27 is attached to the top 12 of base 10 adjacent to end 17 of base 10. As shown in FIG. 1, stiffeners 26, 27 are generally rectangular in shape with the length of stiffeners 26, 27 corresponding with the width of base 10. The stiffeners 26, 27 have openings corresponding with the openings 22, 24 and 25 of the base 10. However, the length of stiffeners 26, 27 may be less than or greater than the width of base 10 and still fall within the scope of the present invention.

Stiffener 30 is mounted to top 12 of base 10 as illustrated in FIG. 1. The stiffener 30 is generally rectangular in shape and is mounted between the ends 16, 17 and sides 18, 19 of base 10 and towards the center of top 12 of base 10. As illustrated in FIG. 1, the length of stiffener 30 is equal to the width of base 10. However, the length of stiffener 30 may be less than the width of base 10 and still fall within the scope of the present invention. The stiffener also has openings which correspond to opening 32 of base 10 for use as hand holds or for straps.

As illustrated in FIGS. 1 and 2, patient support means and child support means 32 in the preferred embodiment is generally rectangular in shape having a top 34, a bottom 36, ends 38, 39, and sides 40, 41. Patient support means 32 is made from material which is flexible and resilient so as to allow the bending or flexing of the patient support means 32 as set forth herein. There are a large variety of materials from which patient support means 32 can be made. These materials include many types of plastics, such as polyvinylchlorine, nylon, lexan, plexiglass, as well as other materials such as fiberglass. In the preferred embodiment, patient support means 32 is rigid and of sufficient thickness and strength to support a patient.

Figure 3:
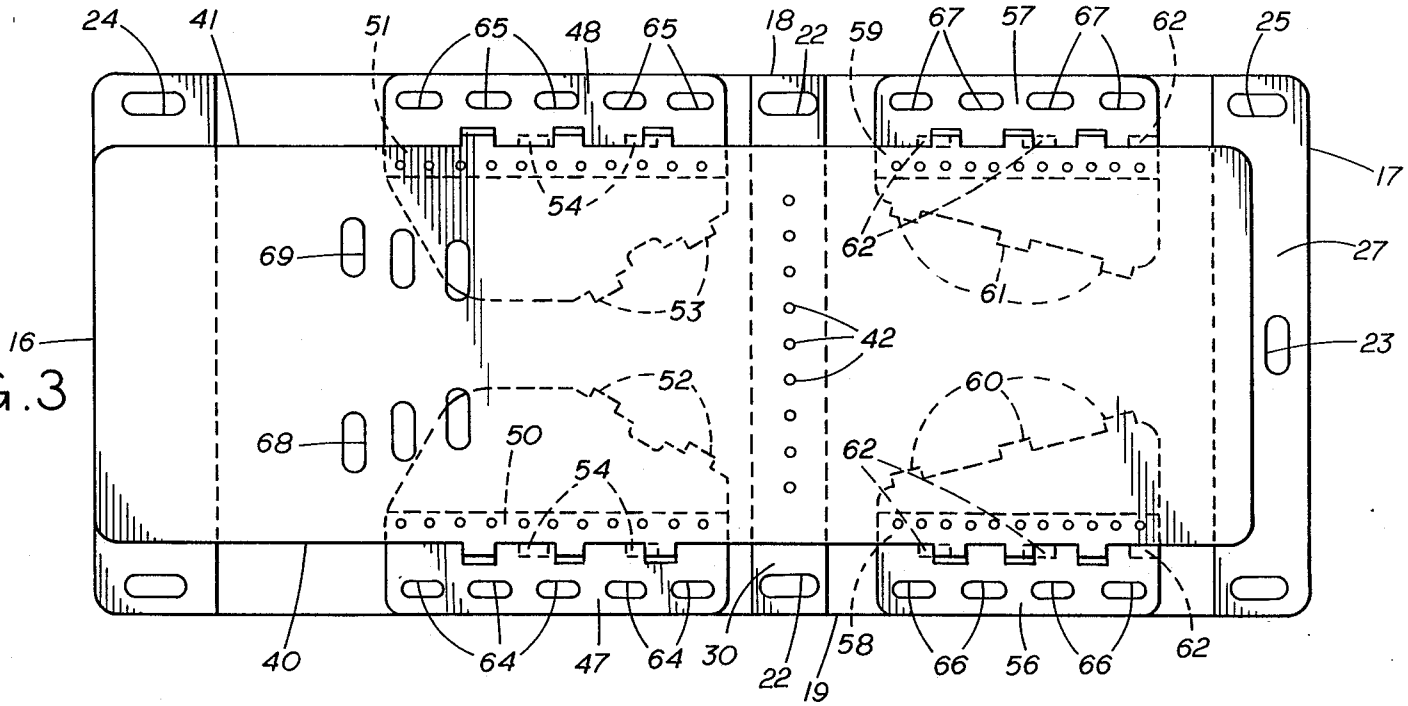
FIG. 3 shows a plan view of the patient support apparatus when the side panels are collapsed and when the patient support means is in its normal position.
Figure 4:
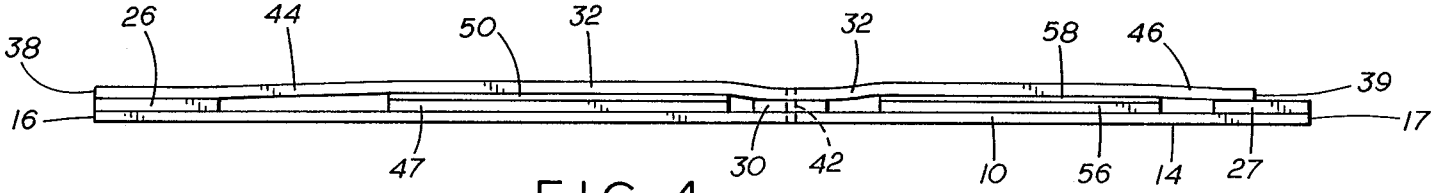
FIG. 4 shows a side view of the FIG. 3 apparatus.
Figure 5:
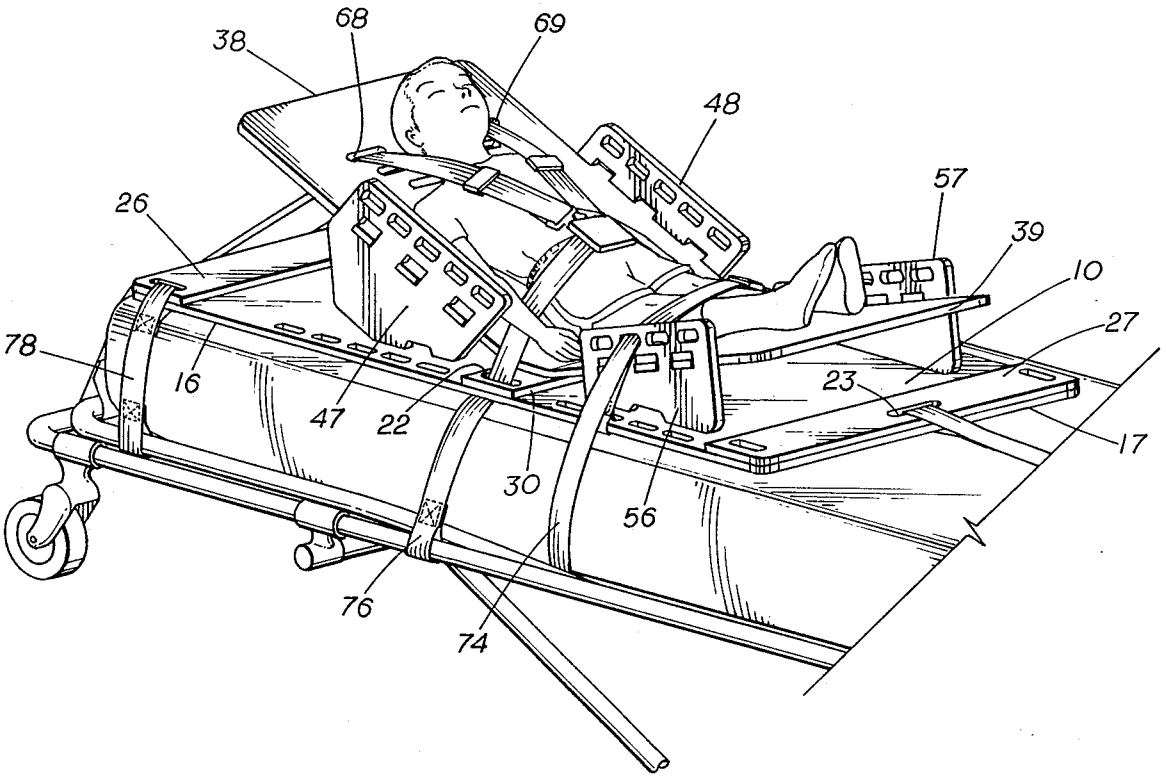
FIG. 5 shows a perspective view of the patient support apparatus carrying a child with the apparatus attached to the stretcher.

As shown in the FIGS. 3 and 4, patient support means 32 is generally flat when in its normal position. Since patient support means 32 is flexible, it may be flexed or bent to the positions shown in FIGS. 1 and 2, as well as a wide variety of other positions which are not shown in the figures but which would fall within the scope of the present invention.

As shown in FIGS. 1 and 3, the width of patient support means 32 is less than the width of base 10. This reduced width facilitates the emergency movement of small children and other humans who are generally too small to be moved by conventional patient support means. However, the width of patient support means 32 could be as wide or wider than base 10 and still fall within the scope of the invention.

As shown in FIGS. 1–4, patient support means 32 is fixedly attached to the base 10 and to stiffener 30 by fastener means 42. The fastener means 42 also serves as a means for attaching the stiffener 30 to base 10. There are a large number of types of fastener means 42 which can be used to attach the patient support means 32 to the stiffener 30 and the base 10. Such fastener means include things such as pop rivets, bolts and nuts, staples, and adhesives. Indeed, any type of fastener means which is strong enough to fix patient support means 32 to stiffener 30 when patient support means 32 is flexed or bent and in use would be sufficient.

The fastener and mounting means 42 divides the patient support means 32 into an upper body member 44 and a lower body member 46. As shown in FIG. 2, the length of upper body member 44 is generally the same as the length of lower body member 46. However, the present invention includes those patient support apparatuses where the length of the upper body member 44 is greater than the length of the lower body member 46 as well as those patient support apparatuses where the length of the lower body member 46 is greater than the length of the upper body member 44.

Since the patient support means 32 is made of a flexible material, the upper body member 44 and the lower body member 46 can be raised from the normal position shown in FIGS. 3 and 4 where these body members 44, 46 are parallel to the base 10 to raised positions shown in FIGS. 1 and 2 wherein the upper body member 44 and lower body member 46 are in angular relationship with base 10. This ability to flex or bend the upper body members 44 and lower body member 46 is important in that positioning of the body members 44, 46 in the raised position is sometimes necessary in moving an injured or sick patient, depending upon the nature of the injury or sickness. In use, a patient is placed on the patient support means so his upper body rests on the upper body member 44 and his lower body correspondingly rests on the lower body member 46. If it is necessary to elevate the lower body of the patient, then the lower body member 46 can be raised from the normal position where the lower body member 46 is parallel to base 10 to the raised position where the lower body member 46 is in angular relationship with base 10. Similarly, if it is necessary for the upper body of a patient to be elevated, then the upper body member 44 can be raised from the normal position where the upper body member 44 is parallel to base 10 to the raised position where the upper body member 44 is in angular relationship with base 10. Further, if it is necessary to elevate both the upper and lower parts of the body, then both the upper body member 44 and lower body member 46 can be raised from the normal positions where the body members are parallel to base 10 to the raised positions where the body members are in angular relationship with base 10. FIG. 2 of the drawings illustrates the patient support apparatus with both body members 44, 46 in the raised position.

Since the patient support means 32 is made of flexible material which is normally in a flat position, it is necessary to support the upper and lower body members 44, 46 of when they are flexed or bent to their raised positions. As illustrated in FIGS. 1 and 2, the upper body member 44 is supported in its raised position by side panels 47 and 48. Each of the side panels 47 and 48 is attached to the bottom 36 of patient support means 32 by hinges 50 and 51. The hinges 50 and 51 are shown as broken lines on FIGS. 1 and 3. The hinges 50 and 51 allow the side panels 47, 48 to move from a collapsed position where the side panels 47, 48 are parallel to the upper body member 44 as shown in FIGS. 3 and 4 to a support position where the side panels 48, 49 are vertical to the upper body member 44 as shown in FIGS. 1 and 2. Each of the side panels 47, 48 have outwardly projecting legs 52 and 53 for registry in openings 54 of base 10 when the side panels 47, 48 are in the support position. When these legs 52, 53 of the side panels 47, 48 are in registry with the openings 54 of base 10, then the side support panels 47, 48 act as braces and supports for the upper body member 44.

Similarly, lower body member 46 has side panels 56, 57 attached to the bottom 36 of lower body member 46 by hinges 58 and 59, which hinges are shown by broken lines on FIGS. 1 and 3. The hinges 58 and 59 allow the side panels 56, 57 to move from a collapsed position where side panels 56 and 57 are parallel to lower body member 46 to a support position where side panels 56 and 57 are vertical to lower body member 46 and base 10. Side panels 56 and 57 have downwardly projecting legs 60 and 61 for registry in openings 62 on base 10 when side panels 56 and 57 are in the support position. In a similar fashion to the support provided by side panels 47 and 48, when legs 60 and 61 of side panels 56 and 57 are in registry with openings 62, then the side panels 56, 57 act as braces and supports from the lower body member 46.

It should be noted that as illustrated in FIG. 2 the legs 52 and 53 of side panels 47 and 48 as well as legs 60 and 61 of side panels 56 and 57 show just one combination of legs which can be used as part of the support mechanism of side panels 47, 48, 56, and 57. Either more legs or fewer legs can be used on these side panels and still fall within the scope of the present invention.

As shown in FIG. 2, parts of side panels 47, 48, 56, and 57 extend above the top 34 of patient support means 32 when the side panels are in their vertical or support position. This extension of the side panels above the top 34 of patient support means 32 provides a means for confining a patient on the patient support means 32. Further, the openings 64, 65, 66 and 67 on the side panels provide a means through which straps may be inserted for further confining the patient to the board.

As shown on FIG. 4, the openings 64, 65, 66 and 67 of side panel 47, 48, 56 and 57 correspond with the openings 20 of base 10 when the side panels are in their collapsed positions and the support means 32 is in its normal flat position. Since these openings 64, 65, 66 and 67 correspond with the openings 20 and 21, then these openings can be used as hand holds in transporting the patient support apparatus.

The upper body member 44 has two rows of openings 68, 69. These openings can be used in securing the entire apparatus to an object such as a stretcher, or alternatively, these openings can be used in securing the patient to the apparatus.

It should also be noted that when the patient support means 32 is in its normal position which is generally flat and parallel to base 10, that the upper end of upper body member 44 rests upon the top of stiffener 26 and the lower end of lower body member 46 rests upon stiffener 27. As shown in FIG. 4, the thickness of stiffener 26 and 27 as well as the thickness of side panels 47, 48, 56 and 57 is approximately the same as the thickness of stiffener 30. Since the thickness of all of these pieces is approximately the same, then each of these pieces provides a support surface for patient support means 32 when its in its normal position. It should also be noted that patient support means 32 can be used for transporting a patient when its in its normal position as well as when it is in a position where one or both of the upper or lower body member 44, 46 has been raised to be in angular relationship with the base 10.

The present invention is not limited to side panels 47, 48, 56 and 57 as being the only support means for supporting the upper or lower body members when they are in their raised position. There are a variety of other methods which can be used to support the flexible patient support means 32 when the upper or lower body members 44, 46 are placed in their raised positions, such as using air bags between the upper and lower body members 44 and 46 and base 10 to support these body members. Alternatively, the side panels could be replaced with sliding bars with notches which would provide a plurality of positions for adjusting the upper and lower body members 44 and 46 in angular relationship with base 10. Another alternative support means would be the use of telescoping rods with tighteners which again would provide a plurality of positions for positioning the upper and lower body members 44 and 46 in angular relationship with the base. All of these alternative support means would fall within the scope of the present invention.

Although as shown in the preferred embodiment the patient support means 32 is a one-piece flexible board, the patient support means could be in multiple pieces, with the pieces hinged or otherwise movably mounted to the base 10 or to stiffener 30. The hinges or movable mounting means would allow the pieces of the child support means to be adjusted to various positions. The child support means would include an upper member and a lower member each of which would be movably mounted to the base. Such a child support means would fall within the scope of this invention.

The patient support apparatus of the present invention is used in the following manner. The patient support apparatus can be carried on an ambulance in its normal position as shown in FIGS. 3 and 4. Since the patient support apparatus lies completely flat in its normal position, it is very easy to store on the ambulance. For example, it could be placed under a mattress of the stretcher and kept there until needed for its use.

The patient support apparatus is removed from the ambulance and taken to the scene of the injured or sick patient. Depending upon the injury or sickness to the patient, the upper body member or lower body member or both can be raised from the normal position to the raised position. Alternatively, the patient support apparatus can be used in its normal position. Once a decision is made on which of the body members to raise, the body members can be raised and the side panels moved from their collapsed position to their support position to insure that the body members are adequately supported. Thereafter, the patient can be moved and placed upon the patient support apparatus. As shown in FIG. 3, once the patient is on the patient support apparatus, the patient support apparatus can be placed on a stretcher. The lower extremities of the patient can be rigidly attached to the patient support means 32 by use of strap 74 through openings 66 and 67 of side panels 56 and 57, with the end of the straps securely engaging the stretcher. The upper body of the patient can be restrained by use of shoulder harness 76 which has straps passing through openings 22, 68, and 69 of the patient support apparatus. Furthermore, the patient is confined on the patient support means 32 by the upwardly extending sections of side panels 48, 49, 56 and 57 which extend above the top of patient support means 32. Again, the end of the straps of shoulder harness 76 can be secured to the stretcher. The apparatus can then be further secured to the stretcher by straps 78 through openings 24.

After the patient support apparatus is secured to the stretcher, the emergency medical vehicle can be driven to the hospital. Either the stretcher carrying the patient support apparatus or the patient support apparatus by itself can then be removed from the ambulance. The patient is then carried from the ambulance to the hospital for treatment.

The method of securing the patient to the patient support apparatus as well as the method of securing the patient support apparatus to the stretcher is just one of a large number of different methods used in securing a patient to the apparatus and stretcher, all of which would fall within the scope of this invention.

What is claimed is:

1. A patient mover for carrying a small child or infant which patient mover can be affixed to a stretcher on an ambulance comprising a flat rectangular base;

a flat, flexible, and rectangular child support means;

fastener means for fastening the longitudinal middle of the child support means to the longitudinal middle of the base so that each end of the child support means is flexible and can be raised above the base;

a plurality of side panels hingedly mounted to the child support means, each of said side panels being movable from a collapsed position wherein the side panel is horizontal to the attached child support means and does not engage the base to a support position wherein each of the side panels is vertical to the attached child support means and does engage the base so as to provide support for the child support means when it is in the raised position; and means for affixing the base to the stretcher.

2. The patient mover of claim 1 with a means for fixing the base to a stretcher includes the flat rectangular base having a plurality of openings around its periphery, and straps for inserting into such openings so as to secure the base to the stretcher.

3. The patient mover of claim 2 wherein the child support means includes an upper member and a lower member each of which are hingedly mounted to the base.

4. A patent support apparatus comprising a flat base having a top, a bottom, sides and two ends;

a flat, flexible, resilient patient support means having a top, a bottom, and two ends;

means for mounting the patient support means to the top of the base so that the patient support means is generally parallel to the base when the patient support means is in a normal position, said means for mounting allowing at least one part of the patient support means to be movable from a normal position relative to the base to a raised position wherein the part of the patient support means is in angular relationship with the base, said means for mounting the patient support means to the base comprising a stiffener body mounted to the top of the base between the ends and sides of the base;

fastener means for fastening a portion of the patient support means to the stiffener body and to the base with said fastener means dividing the patient support means into an upper body member and a lower body member; and means for supporting the part of the patient support means which is movable to the raised position relative to the base when said part of the support means is in its raised position.

5. The patient support apparatus of claim 4 wherein the means for supporting includes at least one side panel hingedly mounted to either the upper body support member or being movable from a collapsed position wherein the side panels the lower body support member, said side panel is horizontal to the attached body support member and does not engage the base to a support position wherein the side panel is vertical to the attached body support member and does engage the base so as to provide support for the attached body support member of the patient support means when it is in its raised position.

6. The patient support apparatus of claim 5 wherein the side panel has at least one leg on an end of the side support panel, and wherein the base has an opening for registering with the leg of the side panel when said side panel is in its vertical position.

7. The patient support apparatus of claim 6 wherein part of the side panel extends above the top of the attached body member when the side panel is in its support position, said part having a plurality of openings.

8. The patient support means of claim 7 wherein the apparatus includes the lower body support member having a plurality of openings for use in restraining the lower body of a patient to the lower body support member; and the base having a plurality of openings around the periphery of the base for use in transporting the patient support apparatus.

9. The patient support apparatus of claim 8 wherein the width of the flexible patient support means is less than the width of the flat base.

10. The patient support apparatus of claim 9 wherein the means for supporting the patient support means includes at least two side panels on each of the upper and lower body support members, each of said side panels being hingedly mounted to the bottom of either the upper body support member or the lower body support member, each of said side panels being movable from a collapsed position wherein the side panel is horizontal to the attached body support member and does not engage the base to a support position where each side panel is vertical to the attached body support member and does engage the base so as to provide support for the attached body support member when said member is in its raised position.

11. The patient support apparatus of claim 10 wherein part of each side panel extends above the top of the attached body member when each side panel is in its support position, said part of each side panel having a plurality of openings.

12. The patient support apparatus of claim 11 wherein each side panel has at least one leg on the end of the side panel, and wherein the base has an opening for registry with each leg of each of the side panel when said side panel is vertical to the attached body support member and said body support member is in its raised position in angular relationship with the base.

13. A patient support apparatus comprising a flat, rectangular base having a top, a bottom, two sides and two ends, said base having a first plurality of openings around the periphery of the base for use as hand holds in moving the apparatus, said base also having a second plurality of openings interior of the first plurality of openings;

a flat, rectangular stiffener mounted to the top of the base between the two ends and two sides of the base;

a flat, rectangular, flexible patient support board mountable to the base and stiffener, said patient support board having a top, bottom and two ends, the width of the patient support board being less than the width of the base;

fastening means for fastening a part of the patient support board approximately mid way between its ends to the stiffener and to the base thereby dividing the patient support member into an upper body member and a lower body member, said fastening means connecting the patient support board to the stiffener and to the base so that each of the upper and lower body members may be moved from a normal position wherein each such body member is generally parallel to the base to a position where each body member is flexed to a raised position wherein each body member is raised above the base and is in angular relationship with the base; and side panels hingedly mounted to each side of each of the upper and lower body members of the patient support body, each of said side panels being movable from a collapsed position wherein the side panel is parallel to the attached body member to a support position wherein the side panel is vertical to the attached body member, each side panel having at least one leg for registry with one of the openings of the second set of openings in the base when said side panel is in the support position.

* * * * *